US005323703A

United States Patent [19]

Blaser

[11] Patent Number: 5,323,703

[45] Date of Patent: Jun. 28, 1994

[54] INSTALLATION FOR SUPPLYING PRESSURIZED GAS TO PRESSURE-MEDIUM ACTUATED SYSTEMS OF A PRINTING MACHINE

[75] Inventor: Peter T. Blaser, Heidelberg, Fed. Rep. of Germany

[73] Assignee: Heidelberger Druckmaschinen AG, Heidelberg, Fed. Rep. of Germany

[21] Appl. No.: 88,450

[22] Filed: Jul. 7, 1993

[30] Foreign Application Priority Data

Jul. 7, 1992 [DE] Fed. Rep. of Germany ..... 4222219

[51] Int. Cl.[5] ..... B41F 13/24

[52] U.S. Cl. ..... 101/247; 101/218

[58] Field of Search ..... 101/247, 218, 219, 152, 101/153

[56] References Cited

U.S. PATENT DOCUMENTS

| | | | |
|---|---|---|---|
| 3,234,874 | 2/1966 | Hornberger et al. | 101/218 |
| 3,731,620 | 5/1973 | Klemmer | 101/247 |
| 4,119,031 | 10/1978 | Ottenhues | 101/153 |
| 4,838,161 | 6/1989 | Naumann et al. | 101/247 |

FOREIGN PATENT DOCUMENTS

| | | | |
|---|---|---|---|
| 1101472 | 10/1955 | France | 101/247 |
| 797964 | 8/1960 | France | 101/247 |
| 588019 | 1/1959 | Italy | 101/247 |
| 641102 | 8/1950 | United Kingdom | 101/247 |
| 240512 | 7/1971 | United Kingdom | 101/247 |

*Primary Examiner*—Eugene H. Eickholt

*Attorney, Agent, or Firm*—Herbert L. Lerner; Laurence A. Greenberg

[57] ABSTRACT

An installation for supplying pressurized gas to pressure medium-actuated systems of a printing machine is disclosed. The installation comprises at least one compressor; a plurality of pressure tanks; and a plurality of sensors for measuring a system pressure, each of the pressure medium-actuated systems of the printing machine having at least one of the pressure tanks and one of the sensors associated therewith; pressure pick-off connections fluidically communicating with the pressure tanks; a pressure medium distribution and feed device for connecting an input side of the pressure tanks to the at least one compressor; the pressure medium distribution and feed device having actuators; and an electrical control apparatus controlling the actuators and the at least one compressor, the control apparatus being connected with the sensors and with the machine control of the printing machine.

5 Claims, 2 Drawing Sheets

INSTALLATION FOR SUPPLYING PRESSURIZED GAS TO PRESSURE-MEDIUM ACTUATED SYSTEMS OF A PRINTING MACHINE

BACKGROUND OF THE INVENTION

Field of the Invention

The invention relates to an installation for supplying a fluid such as gas under pressure to pressure medium-actuated or operated systems of a printing machine, and more particularly to a pneumatic pressure supply installation for a printing machine and sub-units disposed upstream and downstream thereof.

It is known in the context of printing machines to perform a variety of operations by means of pressure medium actuated systems. For instance, a pressure supply installation serves to feed pneumatic operating cylinders, pumps for ink and damping medium and compressed air and suction devices.

A simple installation includes at least a compressor, a pressure tank supplied by the compressor, and a network or ring line, at which various users at the individual printing units, at the feeder and at the delivery are connected via valves. When the number of printing units and of the upstream and downstream sub-units is increased, the number of users of the pressure medium and the number of leaks increases. In that case, compressors and tanks must be adapted to the increased air pressure demand. They must be configured accordingly large with respect to operating power and storage capacity.

Compressors with high power output and tanks with high storage capacity are expensive. Starting at a defined threshold value which is defined as the product of pressure and volume, pressure storage tanks require monitoring, so that further costs are incurred for operating the installation. It is furthermore structurally disadvantageous to dimension the compressor and the tank, corresponding to the number of users, for each printing machine to an optimal characteristic magnitude. The requirement would be for a diversity of compressors and tanks, which is detrimental in terms of expedient manufacture.

The pressure medium requirements at a printing machine are subject to strong deviations over time. For instance, if pneumatic elements at printing machines are only used in adjustment fuctions and automation devices, but not during the actual printing operation, then the pressure medium demand is very high during short time periods and virtually zero during long time periods. This, if leakage losses are neglected. Systems with continuous pressurized air production are thus not suitable in printing machines due to their low degree of efficiency. German published, non-prosecuted application DE-OS 20 47 960 describes a control device for a constant pressure hydraulic installation. Several pressure tanks are charged to respectively different pressure levels by a constant pump connected to the input side. Switching valve configurations are connected downstream on the output side of the pressure tanks. Users may be switched to communicate with a specific pressure tank in dependence of the load on the users. With this hydraulic configuration it is possible to supply each of the parallel-connected users with pressure from that pressure tank which corresponds to the actual load condition. It is disadvantageous in that solution that the pressure tanks have different pressures. It is either necessary to provide machine-type containers corresponding to the specifically required pressures, or one must settle on a certain container size configured to a maximum pressure. The feeding of the containers is effected through pressure-controlled 4/3-way valve configurations which, when a threshold value is attained, are switched to the pressure of the respective container. The supply of the container and the user is effected independently from the control of the system with which the user is associated.

In the apparatus for controlling the pressure air supply from a compressor to several air pressure tanks in a pneumatic installation described in German published, non-prosecuted application DE-OS 15 03 415, check valves are provided between the compressor and the pressure air tanks. The check valves are located in the drive chamber of a pressure regulator and they are actuated by pressure differences. They function as non-return valves for the pressure air tanks and for a compensating chamber into which the compressor feeds directly. A control of the check valves in dependence on signals from the system in which the users are disposed which are connected to the pressure air tanks is not provided in that solution.

A pressure supply device in users according to German document DE 33 00 493 A1 includes a control device for a valve configuration. When the pressure at a second user has dropped below a given threshold the control device actuates the valve device and returns the same after a short time period. In this way, a pressure chamber is alternatively switched in accordance with predetermined conditions at the second user to a pressure source or to a reservoir. In that solution, two separate pressure media are provided for the supply of the two users, which pressure media are separated by means of a medium transfer carrier, whereby the supply device subsists with only one pressure source with a pump. It is thereby disadvantageous that the first user is directly supplied by the pump, so that the pump must continuously operate and that the separation of the two supply circuits causes high expenditure.

SUMMARY OF THE INVENTION

It is accordingly an object of the invention to provide an installation for supplying pressurized fluid to pressure-medium actuated systems of a printing machine, which overcomes the hereinafore-mentioned disadvantages of the heretofore-known devices of this general type and which allows, in modular component fashion, to supply systems in accordance with their actual pressure medium requirement in dependence on the chronological sequence of the operations in the printing machine.

It is a further object of the invention to provide a configuration with which it is easy to recognize and localize malfunctions and leakage locations in the installation, whereby the operation of the printing machine can be continued in an emergency mode when a part of the pressure medium operated system is out of order.

With the foregoing and other objects in view there is provided, in accordance with the invention, in a printing machine having pressure medium-actuated systems and a machine control, an installation for supplying pressurized gas to the pressure medium-actuated systems of the printing machine, comprising at least one compressor, a plurality of pressure tanks and a plurality of sensors for measuring a system pressure, each of the pressure medium-actuated systems of the printing machine having at least one of the pressure tanks and one of the sensors associated therewith; pressure pick-off connections fluidically communicating with the pressure tanks; means in the form of a pressure medium distribution and feed device for connecting an input side of the pressure tanks to the at least one compressor; the pressure medium distribution and feed device having actuators; and an electrical control apparatus controlling the actuators and the at least one compressor, the control apparatus being connected with the sensors and with the machine control of the printing machine.

In accordance with an added feature of the invention, the installation includes several or a plurality of compressors, the pressure medium distribution and feed device connecting the compressors on one side thereof and the pressure tanks on another side thereof in a star point connection.

In accordance with another feature of the invention, the pressure medium distribution and feed devices are electrically actuated.

In other words, the objects of the invention are solved, in accordance with the invention, in that the pressure supply installation, which includes one or several compressors, several pressure tanks with pressure pick-offs and pressure medium distribution and feed devices, has at least one pressure tank and a sensor for detecting the system pressure associated with each pressure medium actuated system of the printing machine. Furthermore, the pressure tanks are connectible to the at least one compressor in star-shape fashion via electrically actuated pressure medium distribution and feed devices. Also, an electrical control device is provided for the actuating devices and for the drive motors of the compressors which communicates with the outputs of the sensors and with the machine control of the printing machine.

The electrical pressure control device and the main printing machine control can form a unit.

The main advantage of the invention lies in the ability to provide a modular air pressure system. Each sub-unit or partial unit, or even only parts thereof, are associated with a module. Each module has a pressure tank which does not require monitoring. When the printing machine is expanded with further partial units, modules are added with additional pressure tanks, so that the available storage volume increases. When a compressor for the supply of a printing machine with a multiplicity of sub-units is no longer sufficient, several compressors, depending on the machine size, may be connected in parallel through the same star point or neutral point through nonreturn valves.

The control device, in cooperation with the machine control, make it possible to adjust the varying sporadic air consumption at different times at the various, pressure medium operated systems and to monitor the entire installation, as well as to indicate malfunctions and to display servicing suggestions.

In accordance with a concomitant feature of the invention, the installation includes 5/3-way valves with a closed center position disposed between each of the pressure tanks and a respectively associated pressure-medium actuated system. Any malfunction within the modular installation can be easily localized and also isolated. The center position of the 5/3-way valve allows the respective pressure medium actuated system of the printing machine to be isolated. The other two positions allow for a pneumatic actuation of the pressure actuated system device, i.e. they connect the respective device to the respective pressure source in the form of a pressure tank.

Other features which are considered as characteristic for the invention are set forth in the appended claims.

Although the invention is illustrated and described herein as embodied in an installation for supplying pressurized gas to pressure-medium actuated systems of a printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
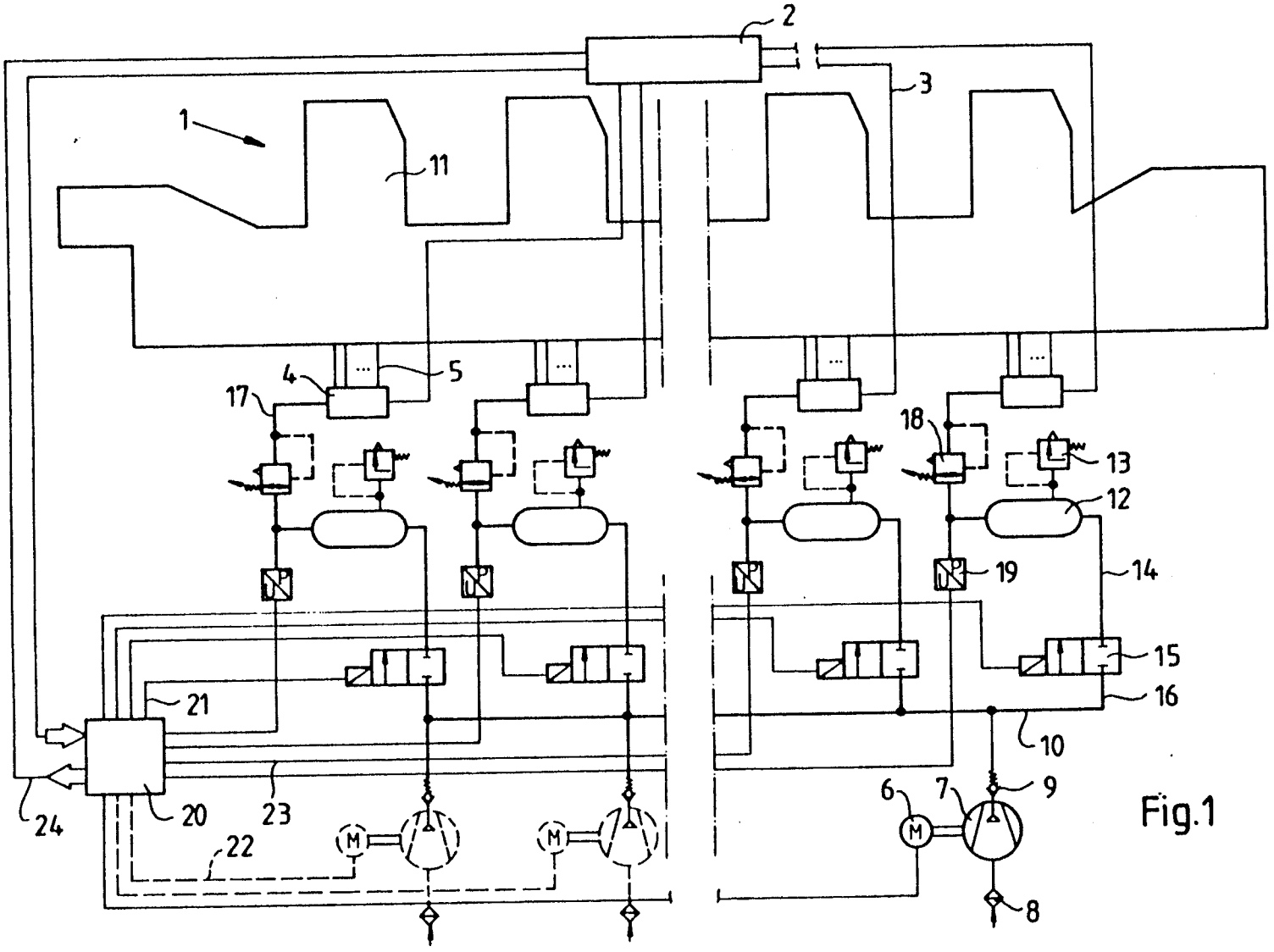
FIG. 1 is a schematic view of the installation according to the invention.

Referring now to the figures of the drawing in detail and first, particularly, to FIG. 1 thereof, there is seen a schematic of a pressure supply installation for a printing machine 1. The printing machine 1 has its own machine control 2. Control lines 3 connect the machine control 2 with electrical actuators of user control valve blocks or batteries 4. The users disposed in the printing machine 1 are connected with the user control valve batteries 4 through power lines 5. The pressure supply installation further includes at least one compressor 7 which is driven by a motor 6. The compressor 7 aspirates the fluid to be pressurized (air) through a filter 8 and feeds the compressed fluid through a check valve 9 into a collecting line or collector ring 10. Furthermore, a pressurized fluid container 12, which will in the following be referred to as a pressurized air tank or a pressure tank 12, is provided for each printing unit 11 of the printing machine 1. Each pressure tank 12 has a pressure relief valve 13. The pressure tanks 12 communicate with output lines 14 of control valves 15, the input lines 16 of which communicate with the collecting line 10.

On the consumer side, i.e. towards the users, the pressure tanks 12 are connected to the user control valve batteries 4 through feed lines 17. Pressure limiters 18 are connected in the feed lines 17. Each pressure tank 12 is provided with a pressure gauge or pressure sensor 19, which senses the pressure in the tank and provides an electrical signal. The pressure sensor 19 may also be referred to as a measurement value converter, as it senses a pressure and issues a proportional electrical signal. A pressure control 20 is connected with the electro-magnetic actuators of the control valves 15 (via lines 21), with the outputs of the pressure sensors 19 (via lines 23), and with the machine control 2 (via lines 24).

The installation functions as follows: The compressor 7 or, if necessary, several compressors 7 charge one or several pressure tanks 12 to a predetermined operating pressure. If required, the associated control valve 15 is thereby switched to throughput by the pressure control 20 (via line 21). The individual printing units 11 have different air pressure requirements at different times which cannot be sufficiently covered by the capacity of a single pressure tank 12 associated with the respective printing unit 11. The sequence of operations occurring at the printing machine 1 and the pressure air requirements for upcoming operations, however, are either stored in the printing machine control 2 or in the pressure control 20. If not stored, they may be calculated therein. The pressure control 20, in cooperation with the machine control 2, therefore, can control the motors 6 and the control valves 15 in such a way that only that pressure tank or those pressure tanks are charged up which must supply pressure air for the nearest future operations.

It is also possible to switch several pressure tanks 12 in parallel by means of the pressure control, if the pressure requirements at one printing unit 11 or another consumer are so high that the capacity of a single pressure tank or of a single compressor 7 is not sufficient and, at the same time, it is foreseen that a user at another location will need a certain amount of air pressure shortly thereafter. It is important, then, that not all pressure tanks 12 be emptied at once.

There exist many different possibilities in terms of switching the installation, i.e. in terms of controlling the motors 6, the control valves 15, and the user control valve batteries 4, in order for the installation to works most efficiently. The modular construction makes an entirely uncomplicated expansion of the installation possible. If each printing unit 11 or sub-unit is provided with one module, each with a motor 6, a compressor 7, a pressure tank 12 and a user control valve battery 6, as well as accessories such as connecting lines and valves, then the installation may be arbitrarily expanded with modules. With the addition of each module, the overall pressure medium storage capacity increases.

Leaks in the installation can be found in an uncomplicated manner, in that the control valves 15 and the user control valve batteries 4 are switched so that they supply pressurized air to exactly one user from only one module. The pressure loss is then determined by means of the corresponding pressure sensor 19 by measuring the closed system over a given time period.

Figure 2:
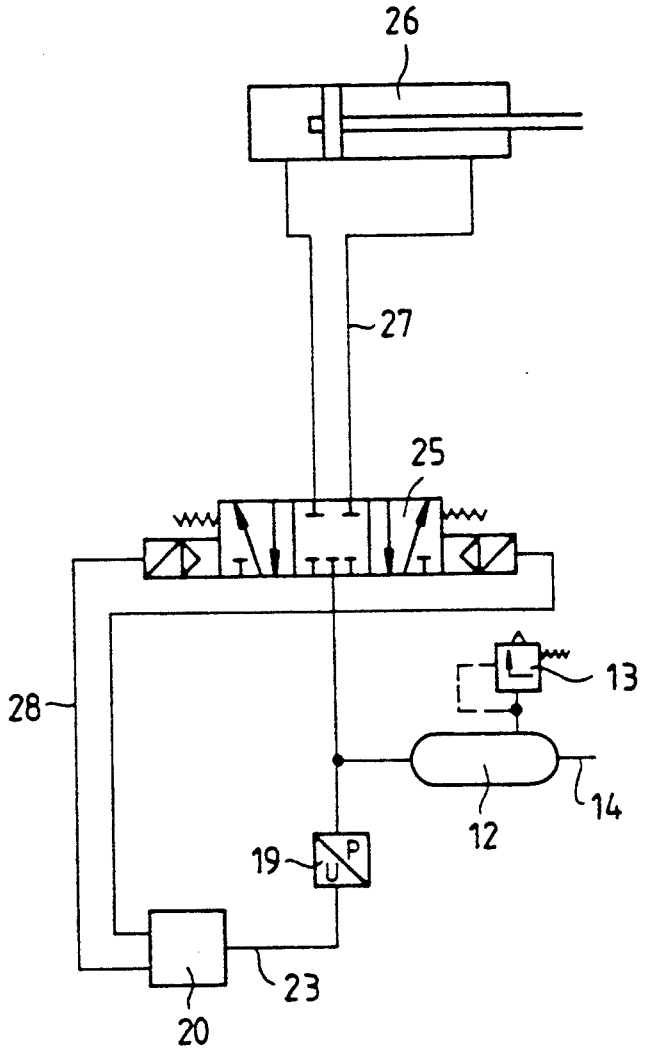
FIG. 2 is an exemplary embodiment with the use of 5/3-way valves.

Referring now to FIG. 2, five-to-three-way valves 25 (5/3-way valves 25) may be advantageously utilized in the installation, as they are schematically shown connected upstream of a working cylinder 26. The 5/3-way valve 25 is a valve with five communicating connections and three positions. For instance, if the electromagnetic actuator operated by the pressure control 20 (via line 28) causes the valve to move to its right-most position, then the air pressure from the tank 12 will connect to the left-hand side of the piston 26. Air from the right-hand chamber of the piston 26 will be forced through the line 27 and, because the valve 25 is open downwardly at the corresponding line connection, the air will bleed out after the valve 25. In order to cause a movement of the piston 26 to the left, the 5/3-way valve piston will be moved to the left, thus connecting the right-hand side of the piston 26 to the pressure in the pressure tank 12, and bleeding the air from the left-hand side. In a closed-circuit fluidic system, of course, the fluid from the bleed lines of the valve 25 may be collected for aspiration through the filter 18 and the compressor 7 back into the pressure medium storage container 12.

In its closed central position, the 5/3-way valve is a component of the user control valve battery 4 which makes it possible to isolate the working cylinder 26 from the pressure air supply.

If, for instance, a leak occurs at the pressure-actuated working cylinder 26 or its supply lines 27, then an unacceptable pressure decrease through a given time period can be determined by the pressure control 20 via the pressure sensor 19, as already described. The pressure control 20, via the control lines 28, can set the 5/3-way valve 25 into its central position, so that the working cylinder 26 is put out of operation because of the leak. Other users which are connected to a corresponding user control valve battery 4 can continue operation without pressure loss. In this way the printing machine 1 can continue in emergency operation even if individual cylinders 26 or feed lines 27 are faulty and have been put out of operation.

I claim:

1. In a printing machine having pressure medium-actuated systems and a machine control, an installation for supplying pressurized gas to the pressure medium-actuated systems of the printing machine, comprising:

at least one compressor, a plurality of pressure tanks and a plurality of sensors for measuring a system pressure, each of the pressure medium-actuated systems of the printing machine having at least one of said pressure tanks and one of said sensors associated therewith; pressure pick-off connections fluidically communicating with said pressure tanks; means in the form of a pressure medium distribution and feed device for connecting an input side of said pressure tanks to said at least one compressor; said pressure medium distribution and feed device having actuators; and an electrical control apparatus controlling said actuators and said at least one compressor, said control apparatus being connected with said sensors and with the machine control of the printing machine.

2. The installation according to claim 1, wherein said at least one compressor is a plurality of compressors, said pressure medium distribution and feed device connecting said compressors on one side thereof and said pressure tanks on another side thereof in a star-type connection.

3. The installation according to claim 1, wherein said pressure medium distribution and feed devices are electrically actuated.

4. The installation according to claim 1, including 5/3-way valves with a closed center position disposed between each of said pressure tanks and a respectively associated pressure-medium actuated system.

5. The installation according to claim 1, wherein said pressure medium distribution and feed device includes 5/3-way valves with a closed center position disposed between each of said pressure tanks and a respectively associated pressure-medium actuated system.

* * * * *